US009576764B2

(12) United States Patent
Jeong et al.

(10) Patent No.: US 9,576,764 B2
(45) Date of Patent: Feb. 21, 2017

(54) FIELD EMITTER ELECTRODE AND METHOD OF MANUFACTURING THE SAME

(71) Applicant: Electronics and Telecommunications Research Institute, Daejeon (KR)

(72) Inventors: Jin Woo Jeong, Daejeon (KR); Jae-woo Kim, Daejeon (KR); Yoon-Ho Song, Daejeon (KR); Jun Tae Kang, Daegu (KR); Sungyoul Choi, Ulsan (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 384 days.

(21) Appl. No.: 14/057,892

(22) Filed: Oct. 18, 2013

(65) Prior Publication Data

US 2014/0111081 A1 Apr. 24, 2014

(30) Foreign Application Priority Data

Oct. 19, 2012 (KR) ..... 10-2012-0116776
Oct. 1, 2013 (KR) ..... 10-2013-0117567

(51) Int. Cl.

| | |
|---|---|
| ***H01J 9/02*** | (2006.01) |
| ***H01J 1/304*** | (2006.01) |
| ***H01J 29/04*** | (2006.01) |
| ***H01J 35/06*** | (2006.01) |

(52) U.S. Cl.

CPC ..... *H01J 9/025* (2013.01); *H01J 1/304* (2013.01); *H01J 29/04* (2013.01); *H01J 35/065* (2013.01); *H01J 2329/0455* (2013.01)

(58) Field of Classification Search

CPC .... H01J 1/304; H01J 2329/0455; H01J 29/04; H01J 35/065; H01J 9/025

USPC ..... 313/346 R; 445/15

See application file for complete search history.

(56) References Cited

U.S. PATENT DOCUMENTS

2006/0082278 A1 4/2006 Lee et al.
2012/0308716 A1* 12/2012 Jeong ..... B82Y 10/00 427/77

FOREIGN PATENT DOCUMENTS

| | | | |
|---|---|---|---|
| KR | 1020060029733 | A | 4/2006 |
| KR | 1020090085838 | A | 8/2009 |
| KR | 1020100076613 | A | 7/2010 |
| KR | 101046976 | B1 | 7/2011 |

* cited by examiner

*Primary Examiner* — Nimeshkumar Patel
*Assistant Examiner* — Jacob R Stern
(74) *Attorney, Agent, or Firm* — William Park & Associates Ltd.

(57) ABSTRACT

Disclosed is a field emitter electrode including a bonding unit formed on a substrate, and a plurality of carbon nanotubes fixed to the substrate by the bonding unit, in which the bonding unit includes a carbide-based first inorganic filler and a second inorganic filler formed of a metal.

16 Claims, 7 Drawing Sheets

FIELD EMITTER ELECTRODE AND METHOD OF MANUFACTURING THE SAME

CROSS-REFERENCE TO RELATED APPLICATION

This application claims priority to and the benefit of Korean Patent Application No. 10-2012-0116776 and 10-2013-0117567 filed in the Korean Intellectual Property Office on Oct. 19, 2012 and Oct. 1, 2013, the entire contents of which are incorporated herein by reference.

BACKGROUND OF THE INVENTION (a) Field of the Invention

The present invention relates to a field emitter electrode and a method of manufacturing the same, and more particularly, to a field emitter electrode including carbon nanotubes, and a method of manufacturing the same.

(b) Description of the Related Art

A field emission device has a structure where electrons emitted from a cathode are accelerated in a vacuum to be led to an anode. Examples thereof include lighting generating visible rays by forming a fluorescent material in an anode, and an X-ray tube generating X-rays by forming a metal target.

Performance of the field emission device largely depends on an emitter electrode that is capable of emitting electrons. Recently, a nanomaterial such as carbon nanotubes (CNT) has been frequently used as an electron emission material for the emitter electrode having an excellent electron emission characteristic.

Carbon nanotubes (CNT) have a geometric structure with a low work function and a high aspect ratio, and thus are useful in field emission. That is, when an electric field is applied to the emitter, the electric field is concentrated on the emitter to emit electrons. The carbon nanotubes have a very high field enhancement factor, and thus may easily emit electrons even in a low electric field.

There are various methods of forming the emitter with the carbon nanotubes. Among the methods, screen printing has merits in that its manufacturing cost is low and mass production is easily performed. In a dipping method of applying a small amount of mixture including carbon nanotubes in a paste state on a cathode, a process of forming the paste on a substrate is simple.

In order to use the screen printing or the dipping method, after the carbon nanotube paste is manufactured, the carbon nanotube paste is subjected to low temperature atmospheric firing, surface treatment, and high temperature vacuum heat treatment steps.

However, the carbon nanotubes are bonded to the substrate by only weak force such as van der Waals force. Accordingly, some of the carbon nanotubes are vaporized due to a high temperature in a manufacturing process, thus deteriorating flatness. In addition, the emitter is partially detached under a high current in a high electric field to generate an arc.

When flatness is deteriorated, field emission locally occurs, and accordingly, there are problems in that lifetime is reduced and stability gets worse.

SUMMARY OF THE INVENTION

The present invention has been made in an effort to provide a field emitter electrode in which bonding strength between a substrate and carbon nanotubes is increased when an emitter is formed by using a carbon nanotube paste, such that the carbon nanotubes are not lost by vaporization even though the carbon nanotubes are exposed to high temperatures, and a density of the carbon nanotubes and flatness of the emitter are improved, and a method of manufacturing the same.

An exemplary embodiment of the present invention provides a field emitter electrode including a bonding unit formed on a substrate. A plurality of carbon nanotubes are fixed to the substrate by the bonding unit. The bonding unit may include a carbide-based first inorganic filler and a second inorganic filler formed of a metal.

The substrate may be formed of an alloy including the second inorganic filler.

The carbon nanotubes may be arranged to protrude in a direction perpendicular to the substrate.

The carbon nanotubes may include at least one of an SWNT, a DWNT, an MWNT, and a thin-MWNT.

The first inorganic filler may include at least one of SiC, TiC, and HfC.

The second inorganic filler may include at least one of Ni, Ta, Cu, Ti, Pd, Zn, Au, Fe, and an alloy thereof.

Another exemplary embodiment of the present invention provides a method of manufacturing a field emitter electrode, including mixing carbon nanotubes, a first inorganic filler, a second inorganic filler, a solvent, and an organic binder on a substrate to prepare a paste, applying the paste on the substrate to form a paste layer, drying the paste layer, primarily heat-treating the paste layer, secondarily heat-treating the paste layer, and surface-treating the paste layer. The first inorganic filler may be a carbide and the second inorganic filler may be a nanometal.

The method may further include surface-treating the paste layer after the primarily heat-treating.

The drying may be performed at a temperature of 90 to 120° C. for 10 to 20 minutes.

The primarily heat-treating may be performed at a temperature of 250 to 400° C. for 1 to 3 hours.

The secondarily heat-treating may be performed in a vacuum at a temperature of 650 to 1000° C.

The carbon nanotubes may include at least one of an SWNT, a DWNT, an MWNT, and a thin-MWNT.

The first inorganic filler may include at least one of SiC, TiC, and HfC.

The second inorganic filler may include at least one of Ni, Ta, Cu, Ti, Pd, Zn, Au, Fe, and an alloy thereof.

In the surface-treating, the carbon nanotubes may be erected in a direction perpendicular to a surface of the substrate.

The surface-treating may be performed by using a roller or a tape.

DETAILED DESCRIPTION OF THE EMBODIMENTS

Figure 1:
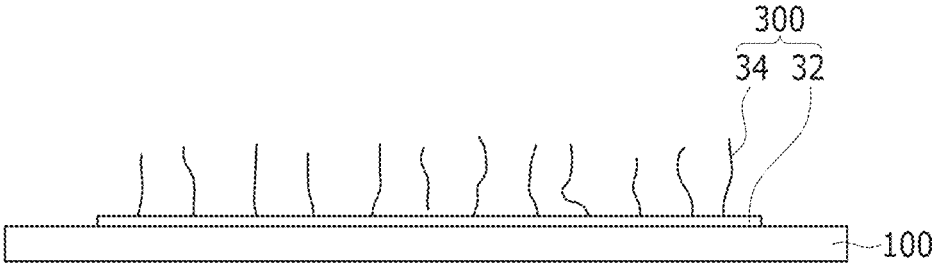
FIG. 1 is a schematic cross-sectional view of a field emitter electrode according to the present invention.

Hereinafter, exemplary embodiments of the present invention will be described in detail with reference to the accompanying drawings so that those skilled in the art may easily practice the present invention. As those skilled in the art would realize, the described embodiments may be modified in various different ways, all without departing from the spirit or scope of the present invention.

In describing the present invention, parts that are not related to the description will be omitted. Like reference numerals generally designate like elements throughout the specification.

In addition, the size and thickness of each configuration shown in the drawings are arbitrarily shown for better understanding and ease of description, but the present invention is not limited thereto.

In the drawings, the thickness of layers, films, panels, regions, etc., are exaggerated for clarity. In the drawings, for better understanding and ease of description, the thicknesses of some layers and areas are exaggerated. It will be understood that when an element such as a layer, film, region, or substrate is referred to as being "on" another element, it can be directly on the other element or intervening elements may also be present.

FIG. 1 is a schematic cross-sectional view of a field emitter electrode according to the present invention.

As shown in FIG. 1, a field emitter electrode 300 according to the present invention includes a bonding unit 32 formed on a substrate 100, and a plurality of carbon nanotubes 34 positioned on the bonding unit 32 and bonded to the bonding unit 32.

The bonding unit 32 is formed of a first inorganic filler including at least one of carbide materials such as SiC, TiC, and HfC, and a second inorganic filler including at least one of Ni, Ta, Cu, Ti, Pd, Zn, Au, Fe, and an alloy thereof as an inorganic material.

For example, when SiC is used as the first inorganic filler and Ni is used as the second inorganic filler, the bonding unit may be a compound including SiC and Ni, such as NiC and $Si_xNi_y$.

The carbon nanotubes 34 include at least one of a SWNT (single-walled carbon nanotube), a DWNT (double-walled carbon nanotube), a MWNT (multiple-wall carbon nanotube), and a thin-MWNT.

The carbon nanotubes 34 are fixed onto the substrate 100 by the bonding unit 32, and arranged in a direction perpendicular to the substrate 100.

Hereinafter, a method of manufacturing the field emitter electrode of FIG. 1 will be described in detail with reference to FIGS. 2 to 5D.

Figure 2:
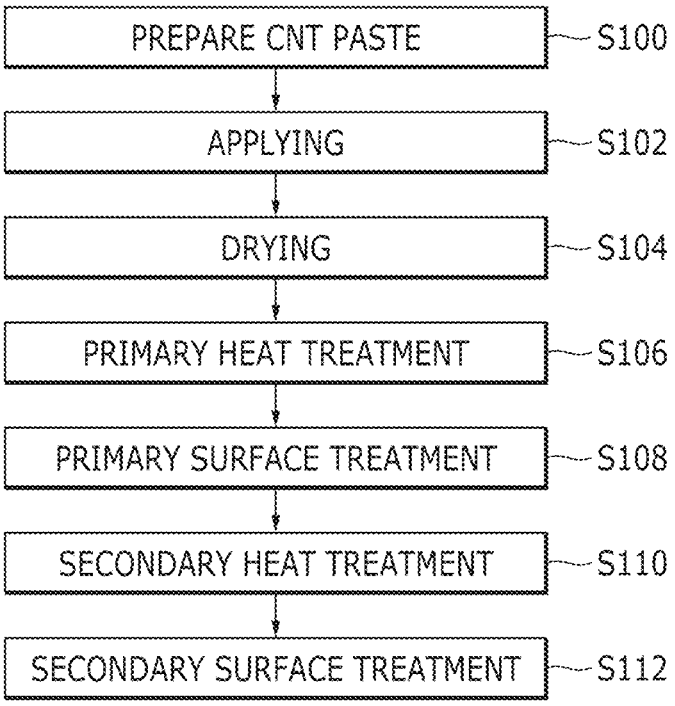
FIG. 2 is a flowchart for showing a method of forming an emitter electrode according to an exemplary embodiment of the present invention.
Figure 3A:
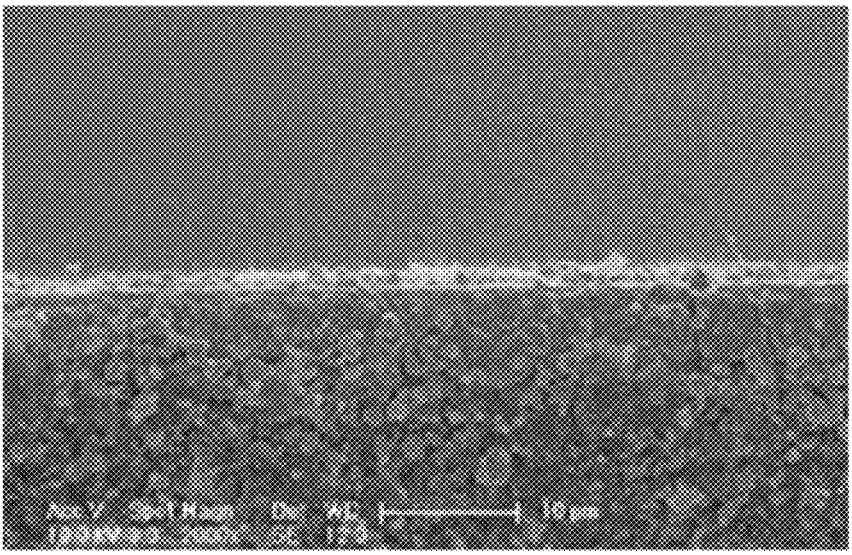
FIGS. 3A and 3B are SEM pictures of the emitter electrode according to the exemplary embodiment of the present invention at an intermediate step.
Figure 3B:
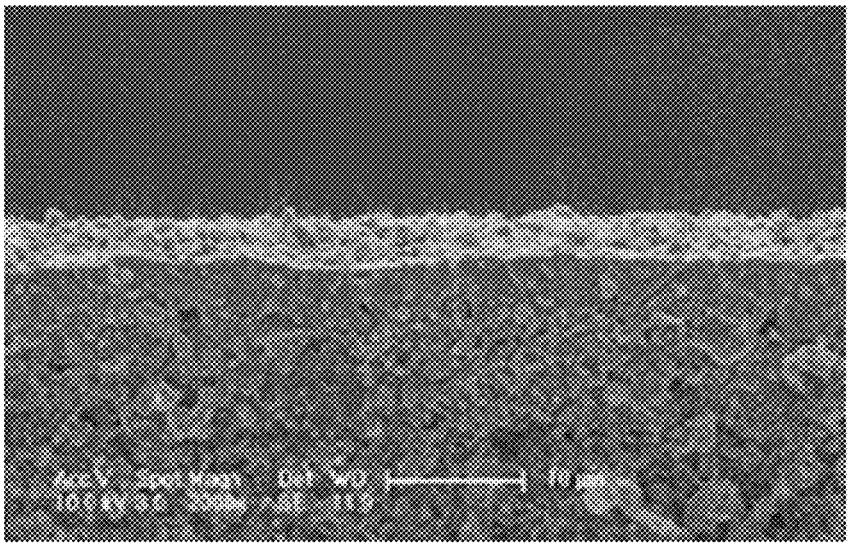

FIG. 2 is a flowchart for showing a method of forming an emitter electrode according to an exemplary embodiment of the present invention, FIGS. 3A and 3B are SEM pictures of the emitter electrode according to the exemplary embodiment of the present invention at an intermediate step, and FIGS. 4A to 4E are cross-sectional views of intermediate steps of manufacturing the emitter electrode according to the order of FIG. 2.

As shown in FIG. 2, the method includes preparing a CNT paste (S100), applying the CNT paste on a substrate (S102), drying (S104), primary heat treatment (S106), primary surface treatment (S108), secondary heat treatment (S110), and secondary surface treatment (S112).

In the preparing of the carbon nanotube paste (S100), the CNT, the first inorganic filler, the second inorganic filler, an organic binder, and a solvent are mixed to manufacture the CNT paste.

The carbon nanotubes include at least one of a SWNT (single-walled carbon nanotube), a DWNT (double-walled carbon nanotube), a MWNT (multiple-wall carbon nanotube), and a thin-MWNT.

The inorganic filler includes a first inorganic filler 10 and a second inorganic filler 20.

The first inorganic filler 10 may be carbide-based nanoparticles in order to increase wettability with the carbon nanotubes including carbon. For example, SiC, TiC, or HfC may be used.

The second inorganic filler 20 is constituted to reduce a melting point of the first inorganic filler 10 to 1000° C. or less, and Ni, Ta, Cu, Ti, Pd, Zn, Au, Fe, and alloys including Ni, Ta, Cu, Ti, Pd, Zn, Au, or Fe may be used. The second inorganic filler may be chemically reacted with the first inorganic filler, and may generate the carbide material or reduce the melting point of the added carbide material by a chemical reaction.

For example, in the inorganic filler, SiC may be used as the first inorganic filler, and Ni may be used as the second inorganic filler.

When the first inorganic filler 10 and the second inorganic filler 20 are included, the substrate and the carbon nanotubes may be strongly bonded by using the first inorganic filler even at low temperatures because of the second inorganic filler.

Meanwhile, the thickness of the formed electrode may be adjusted according to a mixing ratio of the first inorganic filler and the second inorganic filler.

That is, the thickness of the electrode formed by the chemical reaction of the first inorganic filler and the second inorganic filler varies according to an atomic ratio of the first inorganic filler and the second inorganic filler. Accordingly, the electrode having a target thickness may be easily obtained by adjusting the mixing ratio of the first inorganic filler and the second inorganic filler.

The first inorganic filler 10 and the second inorganic filler 20 include the nanoparticles. Accordingly, the thickness of the electrode is adjusted by performing mixing at a volume ratio calculated by using an intrinsic density of the nanoparticles.

FIGS. 3A and 3B are cross-sectional SEM pictures of the emitter electrode according to the exemplary embodiment of the present invention after the heat treatment.

In FIG. 3A, the ratio of the first inorganic filler and the second inorganic filler is 9:1, while in FIG. 3B, the ratio of the first inorganic filler and the second inorganic filler is 7:3.

As shown in FIGS. 3A and 3B, it can be seen that the thickness of the formed electrode is increased as the ratio of the second inorganic filler is increased.

The first inorganic filler 10 is reacted with the substrate 100 to strongly bond the carbon nanotubes to the substrate 100. The amount of the first inorganic filler 10 bonded to the substrate is increased as the amount of the second inorganic filler 20 is increased, and thus the thickness of the emitter electrode including the carbon nanotubes is increased.

In this way, the thickness of the emitter electrode including the carbon nanotubes varies according to the amounts of the first inorganic filler 10 and the second inorganic filler 20. Accordingly, when the ratio thereof is adjusted, the target thickness of the emitter electrode may be formed.

Referring back to FIG. 2, the organic binder is constituted to adjust viscosity and the degree of dispersion of the inorganic filler, and acrylates, acryls, and celluloses may be used. For example, the organic binder may be dipentaerythritol hexaacrylate (DPHA), urethane acrylate, a methacrylate monomer, acrylic resins, ethyl cellulose, or methyl cellulose.

The solvent may be isopropyl alcohol, terpineol, or a mixed solution of butyl carbitol/butyl carbitol acetate having a favorable surface activity characteristic.

The inorganic filler and the organic binder may be mixed in a powder or paste form.

Referring to FIGS. 1 to 4A, in the applying on the substrate 100 (S102), the carbon nanotube paste is applied on the substrate 100 by the screen printing or dipping method.

The substrate 100 may be an alloy including the second inorganic filler. For example, when Ni is used as the second inorganic filler in the second inorganic filler, the substrate 100 may be kovar alloy-based metal.

The drying (S104) is constituted to vaporize the solvent of the paste, and is performed at a temperature of about 90 to 120° C. for 10 to 20 minutes.

Figure 4A:
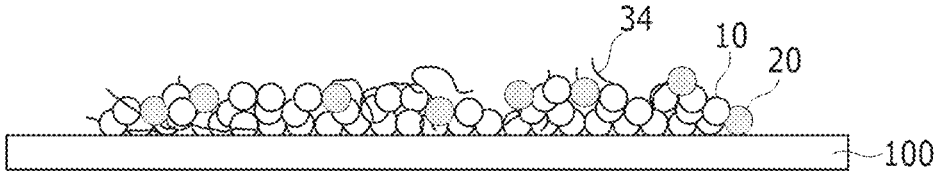
FIGS. 4A to 4E are cross-sectional views of intermediate steps of manufacturing the emitter electrode according to the order of FIG. 2.
Figure 4B:
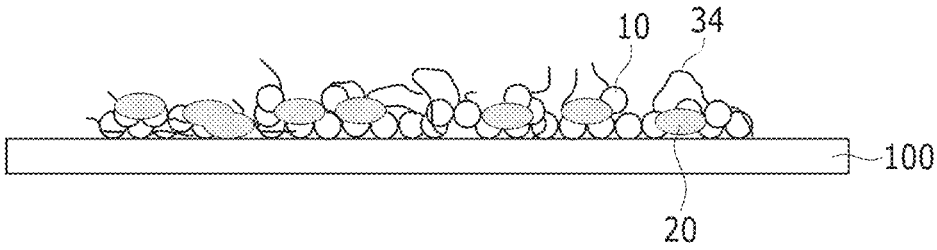

Referring to FIGS. 1 and 4B, the primary heat treatment (S106) is constituted to remove the organic binder and melt the inorganic filler to fire the inorganic filler, and is performed at a temperature of 250 to 400° C. for 1 to 3 hours. In this case, the inorganic filler is melted to physically bond the carbon nanotubes.

When the second inorganic filler is selected as nano-sized particles, the second inorganic filler may be easily melted even at a low temperature of 250 to 400° C. Accordingly, the substrate and the carbon nanotubes 34 may be bonded after the primary heat treatment.

Figure 5A:
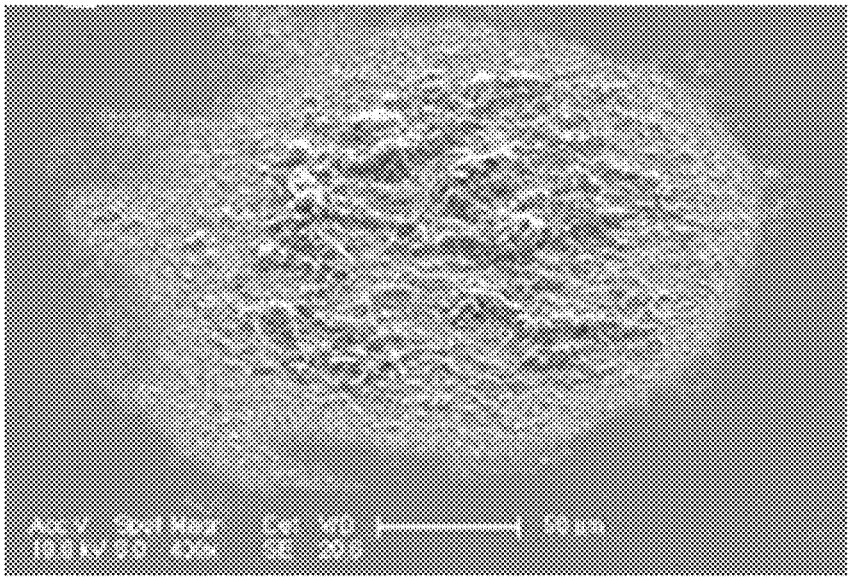
FIG. 5A is a SEM picture after primary heat treatment is performed according to the present invention.

FIG. 5A is a SEM picture after the primary heat treatment is performed at a temperature of 300° C., and it can be seen that the carbon nanotubes are bonded by the inorganic filler.

Figure 4C:
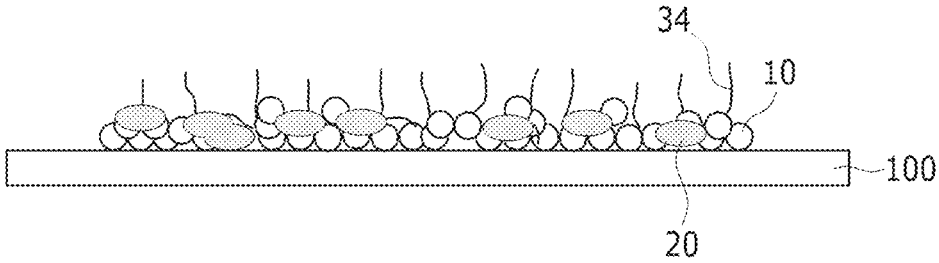

Referring to FIGS. 1 and 4C, the primary surface treatment (S108) activates a surface of the carbon nanotube paste layer on the substrate.

In activation of the surface of the carbon nanotube paste layer, a portion having small adhesion strength and unnecessary paste residual materials are removed by using a roller or tape, and the carbon nanotubes 34 are erected in a direction perpendicular to the substrate 100.

Figure 5B:
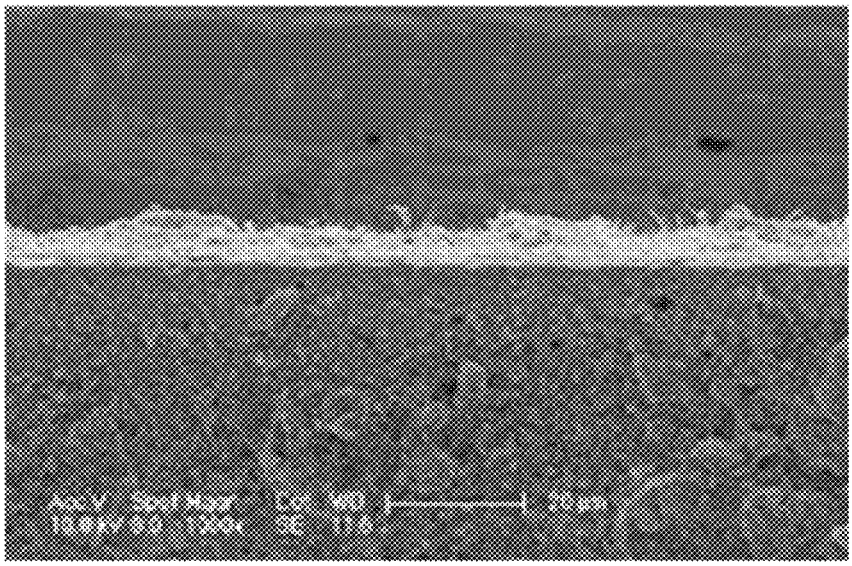
FIG. 5B is a SEM picture after primary surface treatment according to the present invention.

FIG. 5B is a SEM picture after the primary surface treatment, and it can be confirmed that the carbon nanotubes are erected in a direction perpendicular to the substrate and arranged in a protruding form from the substrate.

Figure 4D:
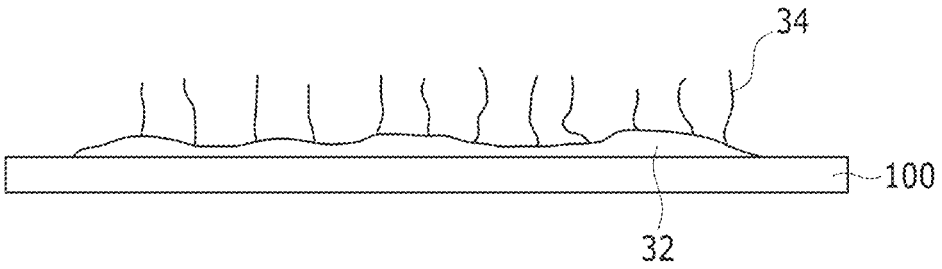

Referring to FIGS. 1 and 4D, in the secondary heat treatment (S110), the emitter electrode 300 formed of the bonding unit 32 for bonding the carbon nanotubes and the carbon nanotubes 34 is formed on the substrate 100.

The second inorganic filler is reacted with the first inorganic filler by the secondary heat treatment (S110) to reduce the melting point of the first inorganic filler to form the bonding unit 32, and to increase adhesion strength between the substrate and the carbon nanotubes to increase flatness of the emitter electrode. In this case, the secondary heat treatment is performed in a vacuum atmosphere at a temperature of 650 to 1000° C. until the inorganic filler is sufficiently melted to form the bonding unit 32 having sufficient bonding strength to the substrate.

Figure 5C:
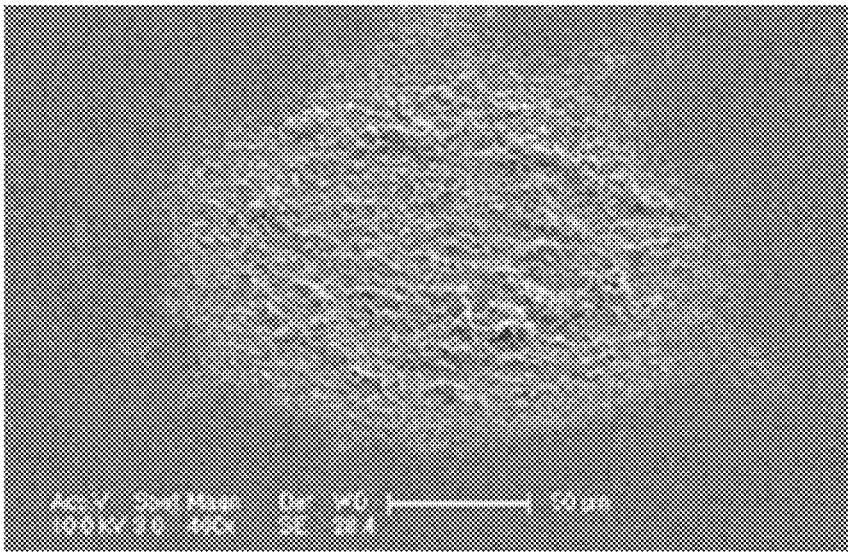
FIG. 5C is a SEM picture after the secondary heat treatment is performed at a temperature of 800° C. according to the present invention.

FIG. 5C is a SEM picture after the secondary heat treatment is performed at a temperature of 800° C., and it can be confirmed that the carbon nanotube paste layer is maintained during a high temperature process to uniformly form the carbon nanotubes without a lost portion by evaporation.

Figure 4E:
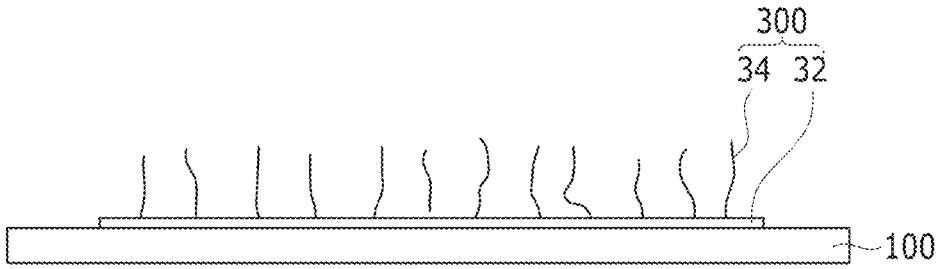

Referring to FIGS. 1 and 4E, the secondary surface treatment (S112) is performed by the same process as the primary surface treatment.

In the secondary surface treatment, flatness of the bonding unit 32 is improved, and the carbon nanotubes are erected once again in a direction perpendicular to the surface of the substrate.

The primary surface treatment and the secondary surface treatment are performed by the same process. Accordingly, the primary surface treatment may be omitted in order to simplify the process.

Figure 5D:
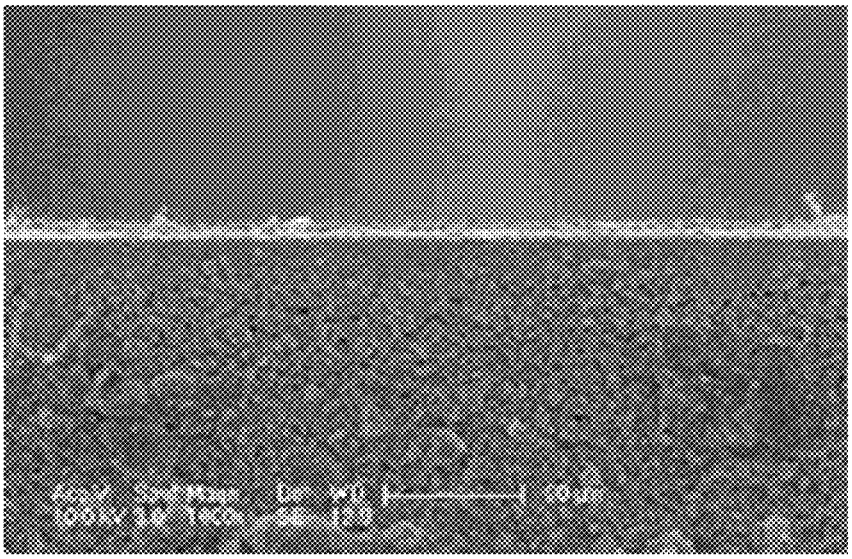
FIG. 5D is a SEM picture after secondary surface treatment according to the present invention.

FIG. 5D is a SEM picture after the secondary surface treatment, and it can be confirmed that a carbon nanotube electrode is flatter than the carbon nanotube electrode after the primary heat treatment and that the carbon nanotubes are uniformly erected.

According to the exemplary embodiments of the present invention, when an electrode is formed as in the present invention, adhesion strength between carbon nanotubes and a substrate can be easily increased even at low temperatures, and flatness of an emitter electrode can be increased to provide a field emitter electrode having improved characteristics.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of Symbols> | |
|---|---|
| 10: first inorganic filler | 20: second inorganic filler |
| 32: bonding unit | 34: carbon nanotubes |
| 100: substrate | 300: emitter electrode |

What is claimed is:

1. A field emitter electrode comprising a bonding unit formed on a substrate, and a plurality of carbon nanotubes fixed to the substrate by the bonding unit, wherein the bonding unit includes a carbide-based first inorganic filler and a second inorganic filler formed of a metal.

2. The field emitter electrode of claim 1, wherein the substrate is formed of an alloy including the second inorganic filler.

3. The field emitter electrode of claim 1, wherein the carbon nanotubes are arranged to protrude in a direction perpendicular to the substrate.

4. The field emitter electrode of claim 1, wherein the carbon nanotubes include at least one of an SWNT, a DWNT, an MWNT, and a thin-MWNT.

5. The field emitter electrode of claim 1, wherein the first inorganic filler includes at least one of SiC, TiC, and HfC.

6. The field emitter electrode of claim 1, wherein the second inorganic filler includes at least one of Ni, Ta, Cu, Ti, Pd, Zn, Au, Fe, and an alloy thereof.

7. A method of manufacturing a field emitter electrode, comprising:

mixing carbon nanotubes, a first inorganic filler, a second inorganic filler, a solvent, and an organic binder on a substrate to prepare a paste;

applying the paste on the substrate to form a paste layer;

drying the paste layer;

primarily heat-treating the paste layer;

secondarily heat-treating the paste layer; and surface-treating the paste layer, wherein the first inorganic filler is a carbide and the second inorganic filler is a nanometal.

8. The method of claim 7, further comprising surface-treating the paste layer after the primarily heat-treating.

9. The method of claim 7, wherein the drying is performed at a temperature of 90 to 120° C. for 10 to 20 minutes.

10. The method of claim 7, wherein the primarily heat-treating is performed at a temperature of 250 to 400° C. for 1 to 3 hours.

11. The method of claim 7, wherein the secondarily heat-treating is performed in a vacuum at a temperature of 650 to 1000° C.

12. The method of claim 7, wherein the carbon nanotubes include at least one of an SWNT, a DWNT, an MWNT, and a thin-MWNT.

13. The method of claim 7, wherein the first inorganic filler includes at least one of SiC, TiC, and HfC.

14. The method of claim 7, wherein the second inorganic filler includes at least one of Ni, Ta, Cu, Ti, Pd, Zn, Au, Fe, and an alloy thereof.

15. The method of claim 8, wherein in the surface-treating, the carbon nanotubes are erected in a direction perpendicular to a surface of the substrate.

16. The method of claim 15, wherein the surface-treating is performed by using a roller or a tape.

* * * * *